US009859084B2

(12) United States Patent
Fasano et al.

(10) Patent No.: US 9,859,084 B2
(45) Date of Patent: Jan. 2, 2018

(54) REMOTE OPERATED CIRCUIT BREAKER WITH MANUAL RESET

(71) Applicants: Michael Fasano, Watertown, CT (US); Jianzhuan Lin, West Hartford, CT (US)

(72) Inventors: Michael Fasano, Watertown, CT (US); Jianzhuan Lin, West Hartford, CT (US)

(73) Assignee: Carling Technologies, Inc., Plainville, CT (US)

( * ) Notice: Subject to any disclaimer, the term of this patent is extended or adjusted under 35 U.S.C. 154(b) by 1131 days.

(21) Appl. No.: 14/025,446

(22) Filed: Sep. 12, 2013

(65) Prior Publication Data

US 2015/0070114 A1 Mar. 12, 2015

(51) Int. Cl.

| | |
|---|---|
| ***H01H 75/00*** | (2006.01) |
| ***H01H 71/24*** | (2006.01) |
| ***H01H 71/32*** | (2006.01) |
| ***H01H 89/08*** | (2006.01) |

(52) U.S. Cl.

CPC ..... *H01H 71/2463* (2013.01); *H01H 71/32* (2013.01); *H01H 89/08* (2013.01)

(58) Field of Classification Search

CPC ..... H01H 89/06

USPC ..... 335/6–16

See application file for complete search history.

(56) References Cited

U.S. PATENT DOCUMENTS

| | | | | |
|---|---|---|---|---|
| 3,171,928 A * | 3/1965 | Powell | H01H 71/52 | 200/560 |
| 3,193,643 A * | 7/1965 | Hollyday | H01H 71/528 | 335/191 |
| 3,305,806 A * | 2/1967 | Norden | H01H 71/528 | 335/174 |
| 3,495,198 A * | 2/1970 | Giger, Jr. | H01H 3/58 | 200/282 |
| 3,706,100 A * | 12/1972 | Halbeck et al. | H01H 71/46 | 335/169 |

(Continued)

FOREIGN PATENT DOCUMENTS

| | | |
|---|---|---|
| CN | 201927563 U | 8/2011 |
| FR | 2799574 A1 | 4/2001 |

(Continued)

OTHER PUBLICATIONS

Japanese Office Action Notice of Reasons for Refusal Application No. 2014-179679 dated May 19, 2015 pp. 6.

(Continued)

*Primary Examiner* — Alexander Talpalatski

(74) *Attorney, Agent, or Firm* — St. Onge Steward Johnston & Reens, LLC

(57) ABSTRACT

A circuit breaker having a movable contact arm for opening and closing the circuit which is controlled separately by a circuit breaker mechanism for circuit protection and by a switch lever mechanism which does not require actuation of the circuit breaker mechanism to function. The switch lever may also be activated remotely by a remote actuator, for example, a solenoid. A manual reset mechanism is provided so that, actuation of which, when power has been lost to the remote actuator when the remote actuator is in the off position, moves the remote actuator to the on position, thereby resetting the circuit to the closed state.

28 Claims, 10 Drawing Sheets

(56) References Cited

U.S. PATENT DOCUMENTS 4,529,951 A * 7/1985 Youichi ..... H01H 71/04 335/13
4,532,486 A * 7/1985 Terrier ..... H01H 89/08 335/13
4,604,596 A * 8/1986 Yokoyama ..... H01H 89/10 335/14
4,636,760 A * 1/1987 Lee ..... H01H 89/08 335/14
4,725,799 A * 2/1988 Bratkowski ..... H01H 89/08 335/14
RE32,882 E * 3/1989 Yokoyama ..... H01H 71/04 335/14
4,947,145 A * 8/1990 Ohishi ..... H01H 71/46 335/14
RE33,325 E * 9/1990 Yokoyama ..... H01H 89/10 335/14
4,982,174 A * 1/1991 Fasano ..... H01H 73/18 218/149
5,053,735 A * 10/1991 Ohishi ..... H01H 89/08 335/14
5,079,529 A * 1/1992 Ohishi ..... H01H 71/1054 335/14
5,164,693 A * 11/1992 Yokoyama ..... H01H 9/46 335/14
5,886,605 A * 3/1999 Ulerich ..... H01H 71/322 335/167
6,414,575 B1 * 7/2002 Swift ..... H01H 71/2481 335/156
6,801,109 B2 * 10/2004 Simms ..... H01H 89/06 335/14
7,034,644 B2 * 4/2006 Moldovan ..... H01H 71/04 335/17
2005/0046526 A1 * 3/2005 Lipsey, II ..... H01H 73/14 335/17
2009/0072933 A1 * 3/2009 Bonetti ..... H01H 71/43 335/16

FOREIGN PATENT DOCUMENTS

FR 2940506 A1 6/2010
JP S58131636 A 8/1983
JP 6030030 A 2/1985
JP S63292545 A 11/1988

OTHER PUBLICATIONS

European Search Report Application No. EP 14 18 4061 Completed: Jan. 30, 2015; dated Feb. 10, 2015 12 pages.

* cited by examiner

| STATE | MECHANISM | LEVER | CONTACT POSITION | CURRENT FLOW | TOGGLE M | TOGGLE L |
|---|---|---|---|---|---|---|
| A | 1 | 1 | CLOSED | ON | D | C |
| B | 0 | 0 | OPEN 1 | OFF | C | D |
| C | 1 | 0 | OPEN 2 | OFF | B | A |
| D | 0 | 1 | OPEN 1 | OFF | A | B |

FIG. 4

REMOTE OPERATED CIRCUIT BREAKER WITH MANUAL RESET

FIELD OF THE INVENTION

The invention relates to remotely operated circuit breakers in general, and more specifically to circuit breakers that are remotely operated using a contact arm which can be operated using a solenoid mechanism that is separate from the circuit breaker handle mechanism.

BACKGROUND OF THE INVENTION

A circuit breaker is a device that can be used to protect an electrical circuit from damage caused by an overload or a short circuit. If a power surge occurs in a circuit protected by the circuit breaker, for example, the breaker will trip. This will cause a breaker that was in the "on" position to flip to the "off" position, and will interrupt the electrical power leading from that breaker. By tripping in this way a circuit breaker can prevent a fire from starting on an overloaded circuit, and can also prevent the destruction of the device that is drawing the electricity or other devices connected to the protected circuit.

A standard circuit breaker has a line and a load. Generally, the line receives incoming electricity, most often from a power company. This is sometimes be referred to as the input into the circuit breaker. The load, sometimes referred to as the output, feeds out of the circuit breaker and connects to the electrical components being fed from the circuit breaker. A circuit breaker may protect an individual component connected directly to the circuit breaker, for example, an air conditioner, or a circuit breaker may protect multiple components, for example, household appliances connected to a power circuit which terminates at electrical outlets.

A circuit breaker can be used as an alternative to a fuse. Unlike a fuse, which operates once and then must be replaced, a circuit breaker can be reset (either manually or automatically) to resume normal operation. When the power to an area shuts down, an operator can inspect the electrical panel to see which breaker has tripped to the "off" position. The breaker can then be flipped to the "on" position and power will resume again.

In general, a circuit breaker has two contacts located inside of a housing. Typically, the first contact is stationary, and may be connected to either the line or the load. Typically, the second contact is movable with respect to the first contact, such that when the circuit breaker is in the "off", or tripped position, a gap exists between the first and second contact, and the line is disconnected from the load.

Circuit breakers are usually designed to be operated infrequently. In typical applications circuit breakers will be operated only when tripped by a power spike or other electrical disturbance. Power spikes do not regularly occur during normal operation of typical circuits.

In some applications however, it is desirable to operate circuit breakers more frequently. For example, in the interest of saving electricity it may be beneficial to control the power distribution to an entire floor of a building from one location. This can be done by manually tripping a breaker for the entire floor circuit. It may also be desirable to manually trip the circuit breaker remotely, using a remote control, timer, motion sensor, or the like.

In other applications, it is desirable to operate a circuit breaker remotely for maintenance purposes. For example, an operator may manually trip a circuit breaker to de-energize a protected circuit so that it can be inspected or serviced.

However in some circuits, operating the breaker can produce a dangerous arc, creating a safety hazard for the operator. In still other circuits, the circuit breaker may be located in a confined or hazardous environment. In these situations, it is also beneficial to operate the circuit breaker remotely.

Known approaches to remotely controlling circuit breakers include incorporating a mechanism into the circuit breaker which can intentionally trip the circuit breaker mechanism and reset it. Examples of such mechanisms are solenoids or motors used to activate the trip mechanism, and solenoids or motors which are used to reset the circuit breaker by rearming the trip mechanism.

However, using a circuit breaker as a power switch or remote control in this way subjects the breaker to a far greater number of operational cycles than it would otherwise experience in a typical circuit protection application. This can result in an unacceptably premature failure of the circuit breaker. Typical circuit breaker mechanisms are designed to survive only 20,000-30,000 cycles before failure.

In order to increase the number of cycles that such circuit breakers can endure before failure, all of the components of the circuit breaker, including the tripping mechanism and any springs, linkages, escapements, sears, dashpots, bimetal thermal components, or other components that are part of the mechanism must be designed in a more robust way than would otherwise be required. This increases the cost of producing the circuit breaker considerably.

These problems were addressed with great success by the invention disclosed in U.S. patent application Ser. No. 13/598,217 filed on Aug. 29, 2012, which application is also assigned to the assignee of the present application. However, even though the design disclosed therein provides significant advantages over previously known remote operated circuit breaker designs, room for additional features has been discovered.

More specifically, while as discussed in U.S. patent application Ser. No. 13/598,217, it may be desirable to "lock" the breaker in the "remote open" state if DC power to the solenoid is lost when the breaker is in that state for the sake of safety, it has been found that in some applications it may be desirable to enable "manual reset" of the circuit breaker in the event the solenoid loses DC power regardless of the position of the solenoid at the time power is lost. For example, when the breaker is in the "remote open" state and the DC power is lost, the permanent magnet in the solenoid may hold the plunger in that position. If this happens when using the previous design disclosed in U.S. patent application Ser. No. 13/598,217, the breaker will not be able to be manually reset to "closed" if the DC power is not present. While this may be desirable for some applications, it may not be desirable for all applications.

What is desired therefore, is a circuit breaker that can be remotely or manually activated and also that allows for the breaker to be able to be manually reset to the "closed" position even if DC power to the solenoid is lost when the breaker is in the "remote open" state.

SUMMARY OF THE INVENTION

Accordingly, it is an object of the present invention to provide a circuit breaker which can be turned on and off remotely.

It is another object of the present invention to provide a circuit breaker which can be turned on and off using a mechanism that is discrete from the circuit breaker mechanism.

It is a further object of the invention to provide a circuit breaker which can be manually reset to the "closed" position even if power to the remote on/off mechanism is lost when the breaker is in the "remote open" state.

These and other objects are achieved by providing a circuit breaker having first and second contacts moveable with respect to each other between a closed state in which electrical current flows through the circuit breaker and an open state in which electrical current is prevented from flowing through the circuit breaker. A linkage assembly is moveable between an engaged position and a disengaged position, wherein when in the disengaged position, the first and second contacts are in the open state. A remote actuator is moveable between an on position and an off position, wherein when the linkage assembly is in the engaged position and when the remote actuator is in the on position, the first and second contacts are in the closed state, and wherein when the linkage assembly is in the engaged position and when the remote actuator is moved to the off position, the first and second contacts are moved with respect to each other to the open state. A manual reset mechanism is provided that, upon actuation when power has been lost to the remote actuator when the remote actuator is in the off position, moves the remote actuator to the on position, thereby resetting the first and second contacts to the closed state.

In some embodiments, the remote actuator comprises a solenoid comprising a plunger and wherein the plunger is moveable between an extended position and a retracted position. In certain of these embodiments, the remote actuator is in the on position when the plunger is in the retracted position and the remote actuator is in the off position when the plunger is in the extended position. In some of these embodiments, the solenoid comprises at least one permanent magnet biasing the plunger to maintain the extended position when power to the solenoid has been lost. In certain of these embodiments, upon actuation of the manual reset mechanism when power to the solenoid has been lost when the remote actuator is in the off position, the plunger is moved against the bias of the at least one permanent magnet from the extended position to the retracted position.

In some embodiments, the circuit breaker further includes a handle manually actuable between an on position and an off position, wherein when the handle is in the on position, the linkage assembly is in the engaged position and wherein when the handle is in the off position the linkage assembly is in the disengaged position. In certain of these embodiments, the manual reset mechanism is actuated, when power has been lost to the remote actuator when the remote actuator is in the off position, by moving the handle from the on position, to the off position and then back to the on position.

In some embodiments, the circuit breaker of claim 1 further includes a tripping mechanism that causes the linkage assembly to move from the engaged position to the disengaged position in response to an electrical current passing through the circuit breaker that exceeds a threshold.

In some embodiments, one of the first and second contacts is stationary with respect to a housing of the circuit breaker and the other of the first and second contacts is moveable with respect to the housing. In certain of these embodiments, the moveable contact is disposed on a lever assembly that is pivotably mounted with respect to the stationary contact. In some of these embodiments, the lever assembly is biased toward a position where in the first and second contacts are in the closed state.

In some embodiments, the lever assembly comprises a contact portion and the camming member, the moveable contact being carried on the contact portion. In certain of these embodiments, the contact portion and the camming member are connected to one another such that there is limited pivotablity therebetween.

In some embodiments, the camming member comprises an outer camming surface facing the remote actuator, the outer camming surface comprising two pockets separated by a protuberance, the pockets adapted to be engaged by a portion of the remote actuator when the remote actuator is in the off position. In certain of these embodiments, the camming member comprises an inner opening with a pin disposed therein, the pin being stationary with respect to a housing of the circuit breaker. In some of these embodiments, the inner opening is generally triangular in shape with one side thereof being generally parallel to the outer camming surface including the pockets, and with a detent being formed in the side thereof that is generally parallel to the outer camming surface including the pockets, the detent being sided and shaped to engage the pin disposed within the inner opening.

Still other objects of the invention and its particular features and advantages will become more apparent from consideration of the following drawings and accompanying detailed description.

BRIEF DESCRIPTION OF THE DRAWINGS

FIG. 4 is a table reflecting various combinations of positions of the elements of the example circuit breaker shown in FIGS. 1-3 according to aspects of the invention.

DETAILED DESCRIPTION OF THE INVENTION

Figure 1:
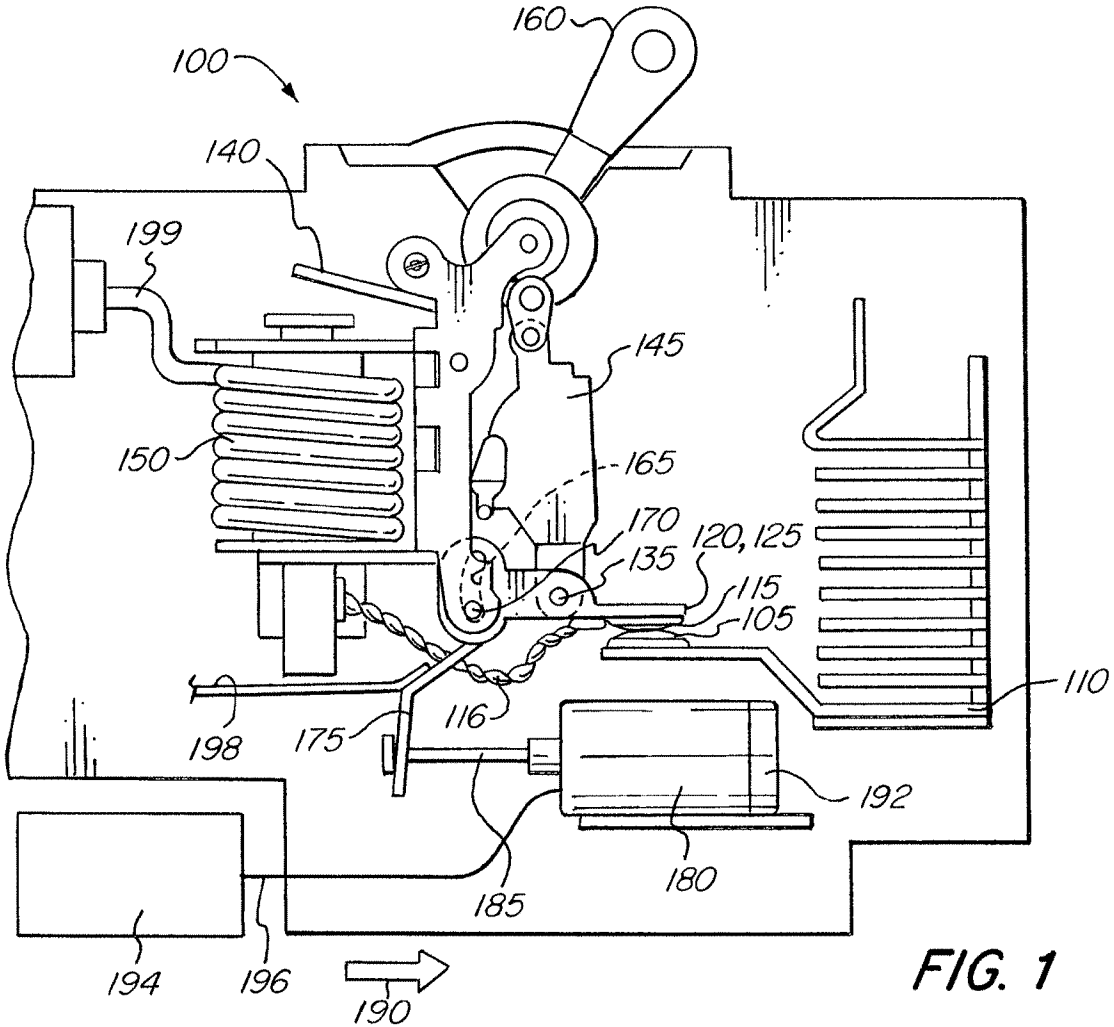
FIG. 1 is a side view of an example circuit breaker according to aspects of the invention, showing a closed position.

FIG. 1 illustrates an example circuit breaker 100 according to aspects of the invention.

Circuit breaker 100 includes a stationary contact 105 connected to a line terminal 110. The line terminal receives electricity from a power source such as a generator (not shown), which in some applications is supplied by a power company.

A movable contact 115 is disposed on a movable contact arm 120 which can be moved between a closed position 125 and open positions 200 and 300 (FIGS. 2 and 3) by pivoting on a first pivot 135 and second pivot 170.

The movable contact arm 120 is connected to a tripping mechanism 140 by a linkage 145. As shown, tripping mechanism 140 is in an untripped state. The linkage may include a spring mechanism (not shown), which is biased to move the movable contact arm from the closed position to the open position when tripping mechanism 140 is tripped.

A fault detector 150 is connected to the movable terminal and is configured to activate the tripping mechanism 140 when a fault condition occurs, such as excess current. In some applications, the fault detector is a solenoid which is disposed inline with the circuit. If the current through the solenoid exceeds a certain level, the solenoid generates an electromagnetic field sufficient to activate the tripping mechanism. The solenoid may also optionally incorporate a plunger or other armature which activates the tripping mechanism when the current exceeds a certain level.

It is understood that other fault detection methods may also be employed, which trip the tripping mechanism upon the occurrence of a specific condition.

Movable contact 115 is connected to load terminal 199 through fault detector 150 and connector 116. When movable contact 115 is in a closed position, as shown in FIG. 1, stationary contact 105 and moveable contact 115 are in contact with each other, and electricity can flow from line terminal 110 to load terminal 199 through contacts 105 and 115.

A handle 160 is also provided for resetting the tripping mechanism 140, or for manually tripping the tripping mechanism 140.

The moveable contact arm 120 includes a guide channel 165 which allows moveable contact arm 120 to slide and/or pivot around second pivot point 170. Moveable contact arm 120 also includes a lever 175. The lever may be formed in one piece with the movable contact arm 120, or may be a separate piece that is attached to the movable contact arm 120.

Actuator solenoid 180 has a plunger 185 which is connected to lever 175. The lever 175, movable contact arm 120, and guide channel 165 are disposed such that when tripping mechanism 140 is in an untripped condition, as shown, and actuator solenoid 180 is activated, plunger 185 moves in the direction of arrow 190, moving movable contact arm 120 from closed position 125 to a second open position (200, FIG. 2) by pivoting movable contact arm 120 around pivot point 135 and sliding guide channel 165 along second pivot point 170.

Incorporating an actuator such as actuator solenoid 180 to open and close contacts 105 and 115 in this way can have the advantage of allowing the number of manual operational cycles of the circuit breaker to be increased without incurring the additional costs associated with increasing the robustness of trip mechanism 140 and its associated components, as they are not actuated when the contacts are opened via the actuator solenoid. In this way, operational life can be increased to approximately 200,000 cycles in a typical application.

Actuator solenoid 180 may be activated using a remote signal. Actuator solenoid 180 may be a bistable or latching solenoid, incorporating a permanent magnet 192. In this case, plunger 185 will hold its position unless actuator solenoid 180 is energized with the correct polarity.

A polarity switch 194 may be connected to actuator solenoid 180 using connector 196. Polarity switch 194 can provide a pulse signal of either polarity to actuator solenoid 180 in order to extend or retract plunger 185. When no signal is present, plunger 185 is held in place by solenoid 180.

Figure 2:
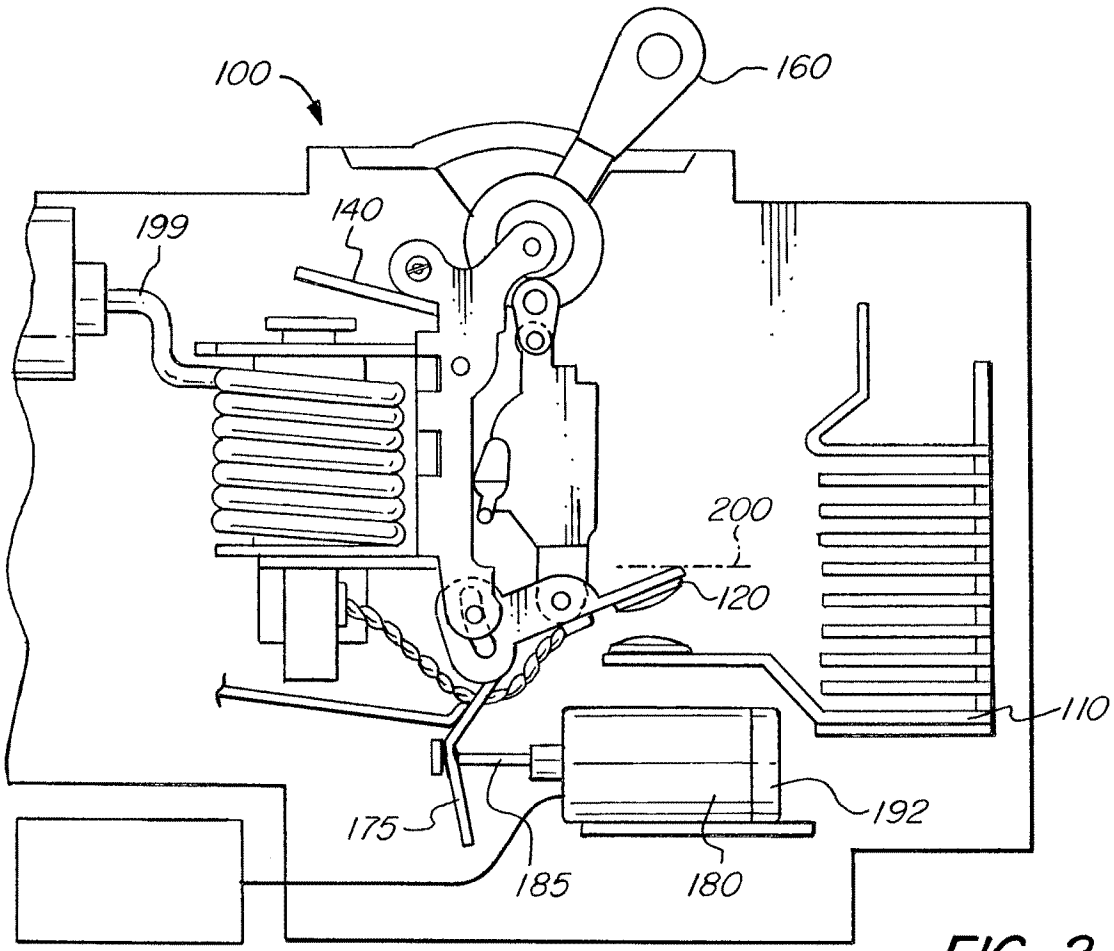
FIG. 2 is another side view of the example circuit breaker shown in FIG. 1, showing a remotely opened position.

Permanent magnet 192 may also be disposed such that when actuator solenoid 180 is de-energized, plunger 185 is drawn in the direction of arrow 190, opening the circuit by moving movable contact 115 from closed position 125 to second open position (200, FIG. 2).

A biasing spring 198 may optionally be disposed to bias lever 175 such that plunger 185 only needs to provide force in one direction.

FIG. 2 illustrates example circuit breaker 100 in a state where as in FIG. 1, the tripping mechanism 140 is untripped, but where movable contact arm 120 is in a second open position 200.

Figure 3:
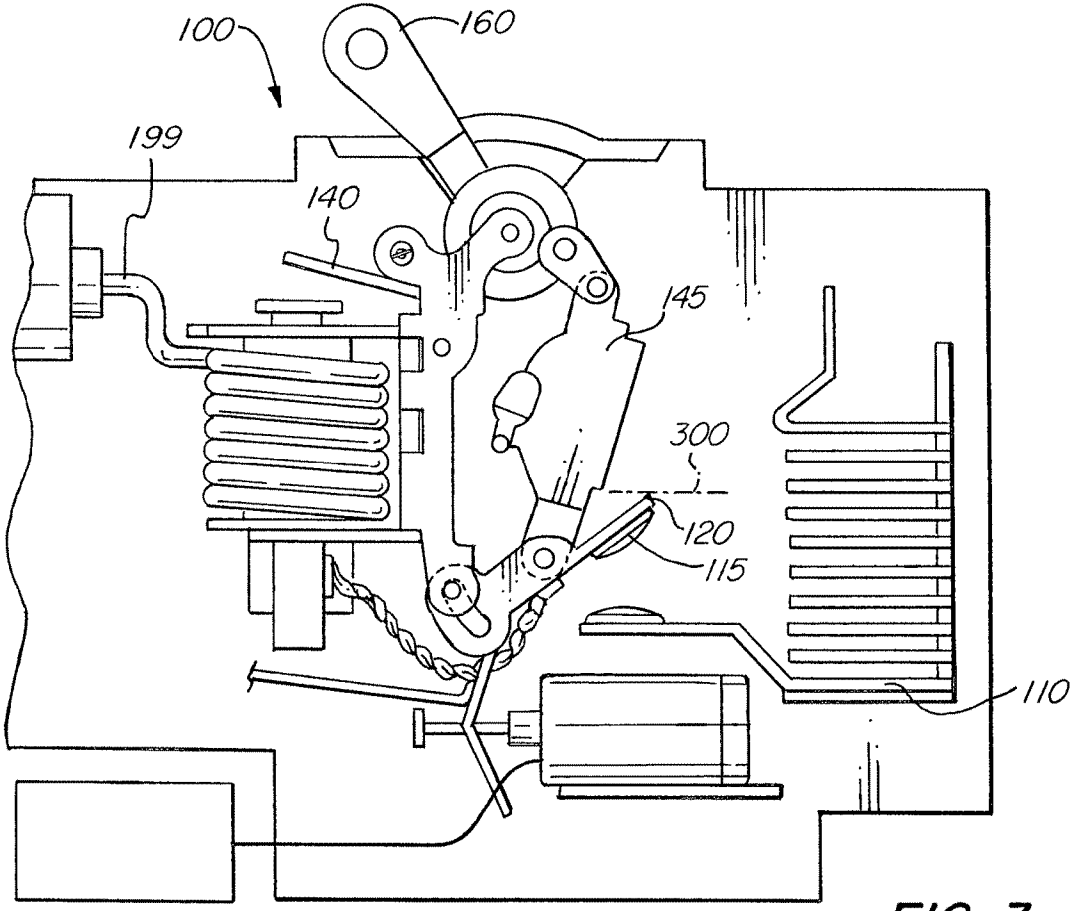
FIG. 3 is another side view of an example circuit breaker shown in FIGS. 1 and 2, showing a tripped position.

FIG. 3 illustrates example circuit breaker 100 in a state where tripping mechanism 140 is tripped. Here, movable contact lever 120 has been moved by tripping mechanism 140 via linkage 145 such that movable contact 115 is held at open position 300. With tripping mechanism 140 in a tripped state, movable contact 115 cannot return to a closed state with stationary contact 105 regardless of the position of plunger 185. This means that it is impossible to re-engage the circuit breaker after a fault using a remote system via actuator solenoid 180.

When the tripping mechanism 140 is in an untripped state as shown in FIGS. 1 and 2, contacts 115 and 105 may be freely opened and closed by actuating solenoid 180. However, when the tripping mechanism 140 is in a tripped state, contacts 115 and 105 cannot be brought back into a closed state by actuating solenoid 180. This can have the advantage of increasing safety by allowing an operator who is directly in the presence of circuit breaker 100 to override any attempts to re-close the breaker remotely or automatically which would result in a hazardous condition.

Similarly, if power to polarity switch 194 is lost preventing actuation of actuation solenoid 180 while it is in the extended position, it remains possible to open contacts 115 and 105 using tripping mechanism 140 or handle 160, and to close contacts 115 and 105 using handle 160. However, if power to polarity switch 194 is lost preventing actuation of actuation solenoid 180 while it is in the retracted position, it is impossible to re-close the contacts using handle 160. This can have the advantage of increasing safety by preventing any attempts to re-close the breaker by operating handle 160 that would result in a hazardous condition. In some applications, an additional mechanism (not shown) may be incorporated to allow plunger 185 of actuation solenoid 180 to be moved to the extended position without requiring power to polarity switch 194. In other embodiments (discussed below in connection with FIGS. 6-9), the circuit breaker can be manually reset to the "closed" position even if power to the remote on/off mechanism is lost when the breaker is in the "remote open" state.

FIG. 4 is a table illustrating the various combinations of circuit breaker positions possible according to the example embodiment of the invention shown in FIGS. 1-3.

When both the circuit breaker mechanism 140 and the lever 175 are in the on position (State A), the movable contact arm is in the closed position, and current can flow through the circuit breaker 100.

From State A, if the circuit breaker mechanism 140 is toggled, e.g. by tripping the circuit breaker mechanism 140 manually or via an overcurrent condition, the moveable contact arm 120 moves to the first open position 300, and current can no longer flow through the circuit breaker 100.

From State A, if the lever 175 is toggled, e.g. by remotely activating an actuation solenoid, the moveable contact arm 120 moves to the second open position, and current can no longer flow through the circuit breaker 100.

When both the circuit breaker mechanism 140 and the lever 175 are in the off position (State B), the contact arm is in the first open position 300, and current cannot flow through the circuit breaker 100.

From State B, if the circuit breaker mechanism 140 is toggled, e.g. by resetting the circuit breaker mechanism, the movable contact arm 120 moves to the second open position, and current still cannot flow through the circuit breaker 100. This can have the advantage of enabling a remote operator to prevent current flow even if a local operator were to reset the circuit breaker, for example, when a safety hazard is known to the remote operator.

From State B, if the lever 175 is toggled, e.g. by remotely activating an actuation solenoid, the moveable contact arm 120 moves to the first open position 300, and current still cannot flow through the circuit breaker 100. This can have the advantage of enabling a local operator to prevent current flow even if a remote operator attempts to switch on the breaker, for example, when a safety hazard is known to the local operator.

When the circuit breaker mechanism 140 is in the on position and the lever 175 is in the off position (State C), the movable contact arm is in the second open position, and current cannot flow through the circuit breaker.

From State C, if the circuit breaker mechanism 140 is toggled, e.g. by tripping the circuit breaker mechanism 140 manually or via an overcurrent condition, the moveable contact arm 120 moves to the first open position 300, and current still cannot flow through the circuit breaker 100.

From State C, if the lever 175 is toggled, e.g. by remotely activating an actuation solenoid, the movable contact arm moves to the closed position, and current can flow through the circuit breaker 100.

When the circuit breaker mechanism 140 is in the off position and the lever 175 is in the on position (State D), the movable contact lever 175 is in the first open position 300, and current cannot flow through the circuit breaker 100.

From State D, if the circuit breaker mechanism 140 is toggled, e.g. by resetting the circuit breaker mechanism, the movable contact lever 175 moves to the closed position, and current can flow through the circuit breaker 100.

From State D, if the lever 175 is toggled, e.g. by remotely activating an actuation solenoid, the movable contact arm moves to the first open position 300, and current still cannot flow through the circuit breaker 100.

Figure 5:
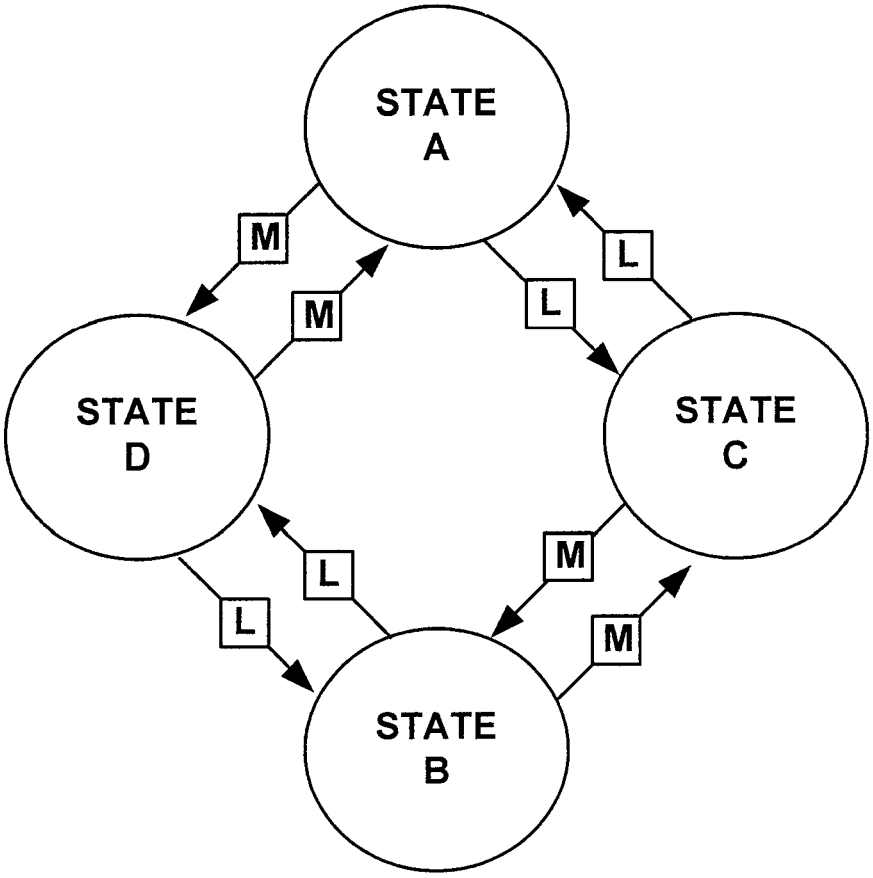
FIG. 5 is a state diagram reflecting various state transitions possible for the example circuit breaker shown in FIGS. 1-3 according to aspects of the invention.

FIG. 5 is a state diagram illustrating the different state transitions possible according to the example implementation of the circuit breaker shown in FIGS. 1-3, and as reflected in the table of FIG. 4. The only state which allows current to flow through the circuit breaker is State A. It is clear from the state diagram that it is impossible to transition directly from State B to State A without first passing through either State D or State C. Thus, State B can be thought of as a safety state of the circuit breaker 100.

A transition to State A from State D is controlled by the circuit breaker mechanism 140, e.g., the local operator who can reset the mechanism. A remote operator can initiate a transition from State B to State A only by encountering State D, which is controlled by the local operator.

Similarly, a transition to State A from State C is controlled by a lever operator, e.g., a remote operator actuating the lever 175 using solenoid 180. A local operator can initiate a transition from State B to State A only by encountering State C, which is controlled by the remote operator.

In this way, the circuit breaker 100 can be configured to provide an added layer of safety by requiring logical agreement between the operators of the circuit breaker 100 before energizing a protected circuit.

Referring now to FIGS. 6-9B, as noted above, it may be desirable in some applications for the circuit breaker to be capable of being manually reset to the "closed" position even if power to the remote on/off mechanism is lost when the breaker is in the "remote open" state. This feature is provided in the exemplary embodiment of the invention shown in FIGS. 6-9B.

In many respects, the circuit breaker 600 operates in substantially the same way as does the circuit breaker 100 described above in connection with FIGS. 1-3. As such, rather than repeat similar features and operations, only the differences between circuit breaker 600 and previously described circuit breaker 100 are discussed herein.

One of the most obvious differences relates to the position of the solenoid. In the embodiment of the circuit breaker 100 shown in FIGS. 1-3, the actuation solenoid 180 is disposed on the same side as the contacts 105, 115 with respect to a vertical plane passing through the pivot point 135 of the lever 175, such that the plunger 185 of the solenoid 180 is extended to close the contacts 105, 115 and is retracted to open the contacts 105, 115. In the embodiment of the circuit breaker 600 shown in FIGS. 6-9B, on the other hand, the actuation solenoid 680 is disposed on the opposite side as the contacts 605, 615 with respect to a vertical plane passing through the pivot point 635 of the lever assembly 675, such that the plunger 685 of the solenoid 680 is retracted when the contacts 605, 615 are closed (FIG. 6) and is extended to remotely open the contacts 605, 615 (FIG. 7).

Another obvious difference is that the relatively simple lever 175 of the circuit breaker 100 has been replaced with a much more complex lever assembly 675 that provides significantly different functionality.

Like lever 175 of circuit breaker 100, lever assembly 675 includes a contact portion 676 on which moveable contact 615 is disposed, the contact portion 676 being pivotally mounted on a linkage 645 about a pivot point 635 and having a pin 670 slideably disposed within a channel 665. As operation of these elements is similar to operation of the circuit breaker 100 described above, further detail is not provided.

However, unlike circuit breaker 100, wherein the lever 175 includes a simple extension engaged by the plunger 185 of the solenoid 180, lever assembly 675 includes a camming member 677 having a much more complex shape. The camming member 677 is attached to the contact portion 676 with limited pivotability about a pivot point 678. What is meant by limited pivotability is described in more detail below.

An outer surface of the camming member 677 facing the solenoid includes two pockets 679 separated by a protuberance therebetween, the pockets 679 adapted to be engaged by a terminal end of the plunger 685 of the solenoid 680 when the plunger 685 is extended. The purpose of these pockets 679 is explained in more detail below.

The camming member 677 also includes an inner opening 681 provided therein. The inner opening 681 is generally triangular in shape with one of its sides 683 being generally parallel to the external surface of the camming member 677 including the pockets 679. A detent 682 is provided toward the upper end of the aforementioned side 683, the detent being sized to accommodate a pin 684 disposed within the opening 681 and mounted in stationary fashion with respect to the housing. Again, the purpose of the opening 681, the detent 682 and the pin 684 is described in more detail below.

Figure 6:
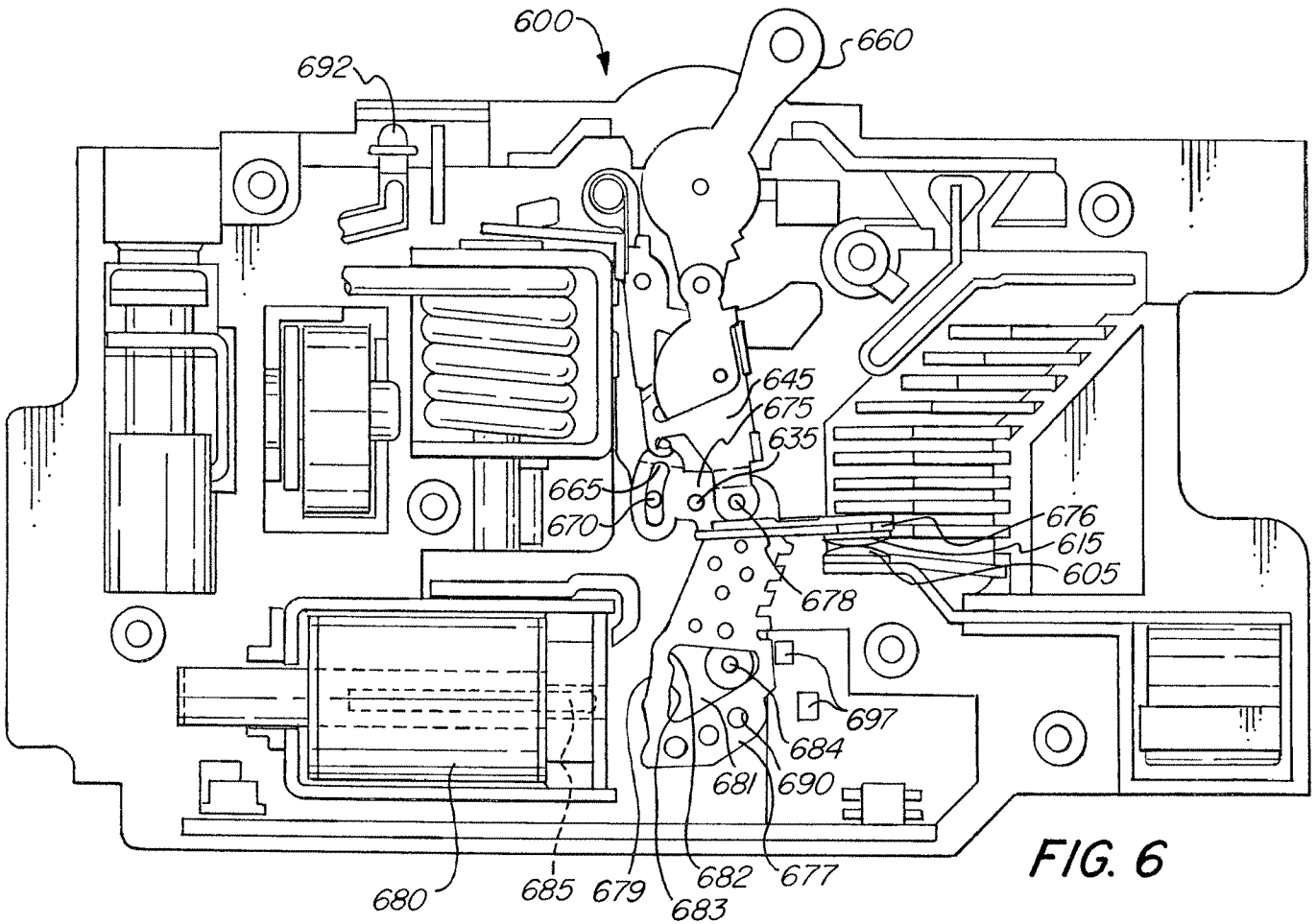
FIG. 6 is a side view of an second example circuit breaker according to aspects of the invention, showing a closed position.
Figure 7:
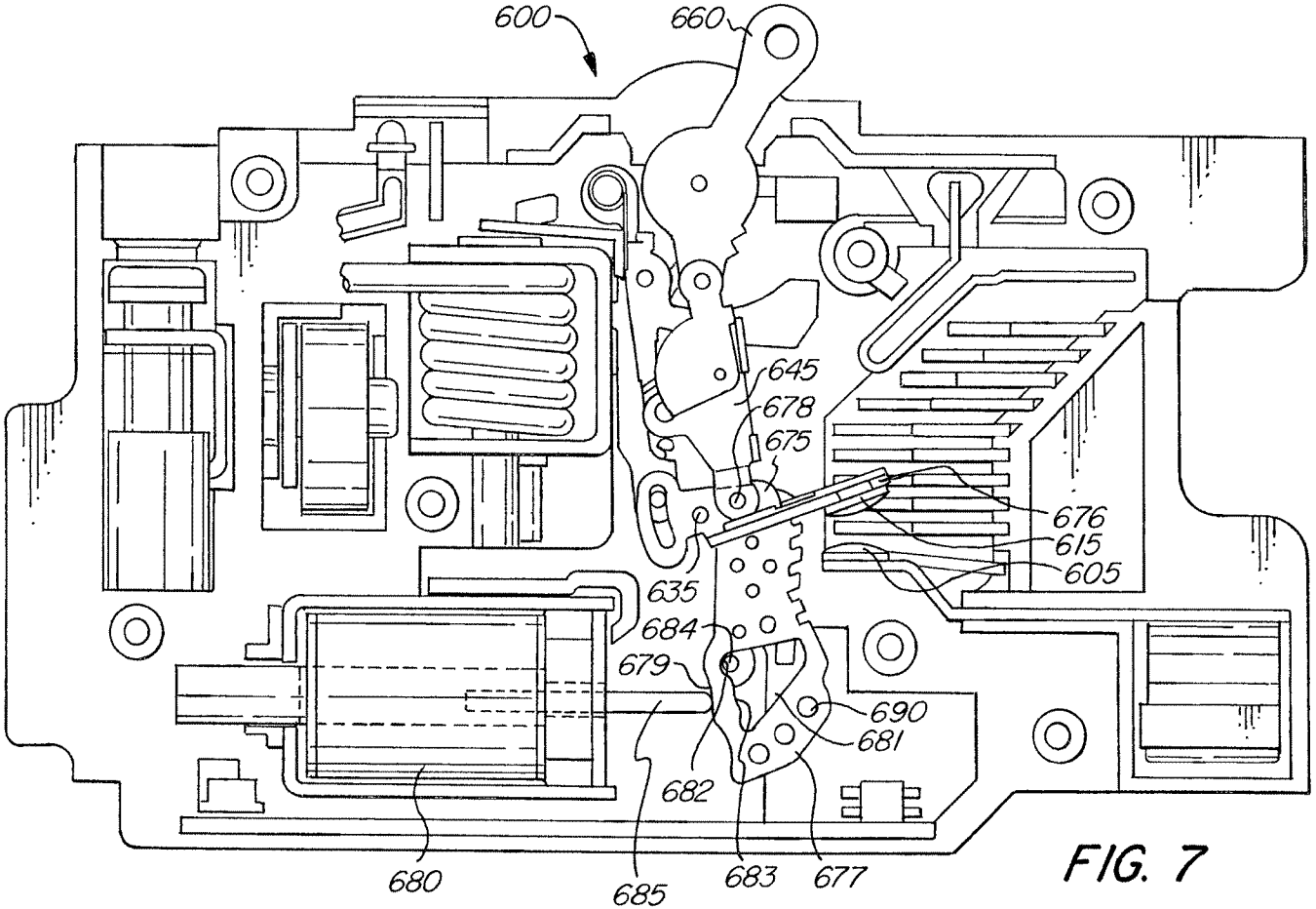
FIG. 7 is another side view of the second example circuit breaker shown in FIG. 6, showing a remotely opened position.

The camming member 677 may be provided with a magnet 690 that may be employed to trigger one or more (two are shown in FIG. 6) Hall effect sensors 691 mounted in stationary fashion with respect to the housing of the circuit breaker 600 in order to provide signals indicative of the position of the camming member 677, and thereby an indication of the status of the circuit breaker 600 (e.g., closed, remotely tripped, manually tripped, etc.). The position indicative signal may be transmitted to a remote location, for example, to a power management system and/or may be used to locally indicate status of the circuit breaker, for example, via a LED status indicator 692.

Referring now to FIGS. 6-9B, operation of the circuit breaker will be discussed in more detail.

Referring first to FIG. 6, a closed position of the circuit breaker 600 is shown. The handle 660 is in the on position (i.e., toward the right in the figure), the plunger 685 of the solenoid 680 is retracted (i.e., in the remotely closed position), and the circuit breaker has not been tripped. In this case, the linkage 645 is in its closed position, and the contacts 605, 615 are biased closed so that electricity can flow.

Referring now to FIG. 7, a remote open position of the circuit breaker 600 is shown. The handle 660 is in the on position (i.e., toward the right in the figure), and the circuit breaker has not been tripped. Thus, the linkage 645 is in its closed position. However, the plunger 685 of the solenoid 680 has been extended (i.e., to the remotely open position). The terminal end of the plunger 685 has thus engaged the upper pocket 679 in the outer surface of the camming member 677 and pivoted the camming member 677 to the right about pivot point 678, with the detent 682 in the side 683 of the inner opening 681 accommodating the stationary pin 684. As can be seen in the figure, the upper surface of the camming member 677 to the right of the pivot point 678 is already in contact with the underside of the contact portion 676 of the lever assembly 675, such that the contact portion 676 pivots with the camming member 677 so that the contacts 605, 615 are moved against the bias and out of contact with one another to the remote open position so that electricity cannot flow therethrough.

It should be noted that the gap between the contacts 605, 615 in this remote open position is smaller than the gap that exists when the circuit breaker is in the tripped or manual off positions (shown in FIG. 8 and discussed below). It should also be noted that the magnet 690 in this remote open position covers/activates the lower of the two Hall effect sensors 691.

As mentioned above, suppose now that the solenoid 680 loses power (usually DC power) thereto while in the remote open position shown in FIG. 7. As discussed above in connection with the circuit breaker 100 shown in FIGS. 1-3, the solenoids 180, 680 used usually employ permanent magnets which will hold the plunger in position if power is lost. Thus, if power to the solenoid 680 is lost when in the remote open position, permanent magnets in the solenoid 680 will attempt to hold the plunger 685 in the extended position. The embodiment shown in FIGS. 6-9B allows for the force of the permanent magnets to be overcome so that the plunger may be manually reset to the retracted position so that the circuit breaker 600 may be manually reset to the closed position (shown in FIGS. 9A and 9B).

Figure 8:
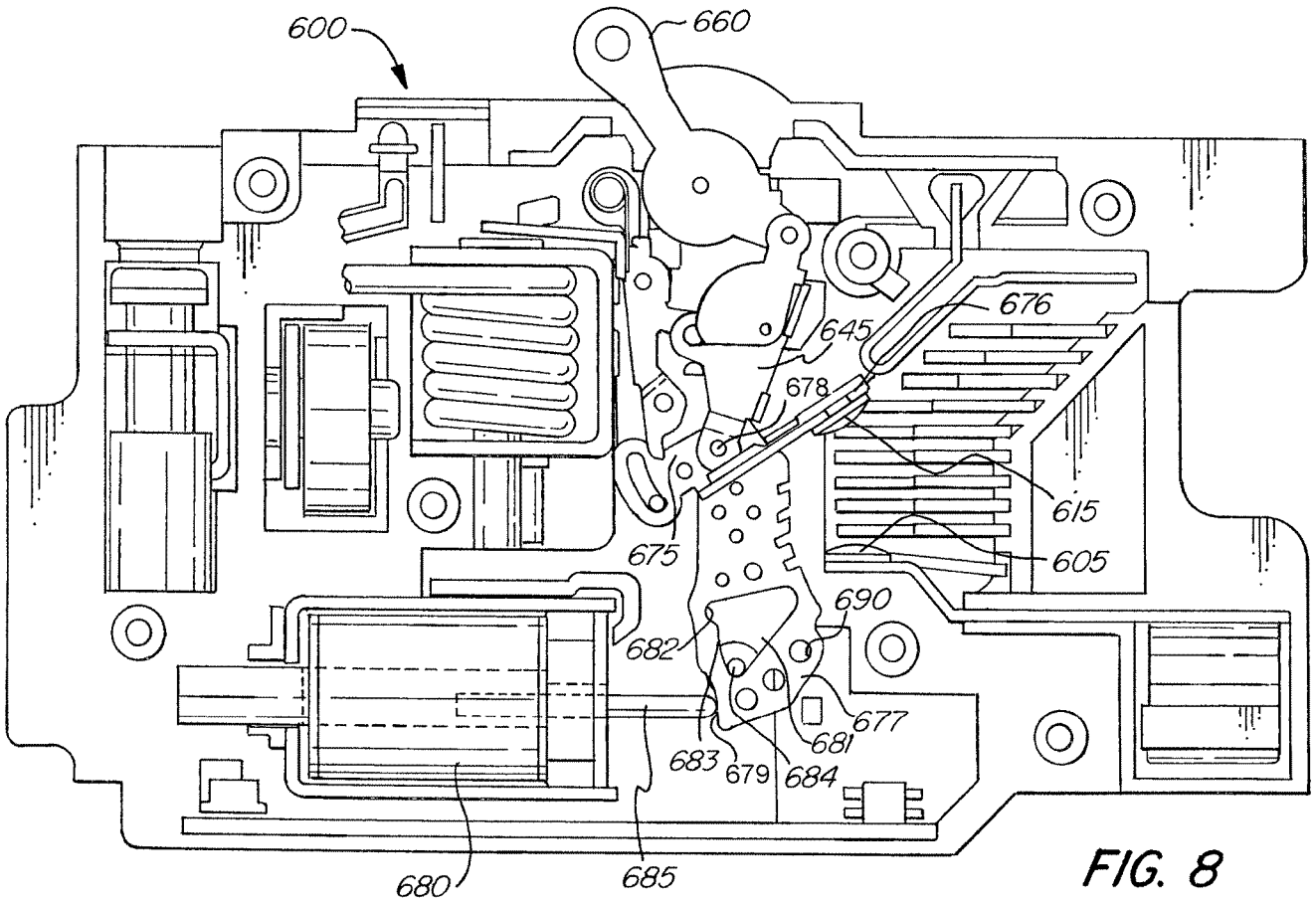
FIG. 8 is another side view of the second example circuit breaker shown in FIG. 6, showing a manually open or tripped position.

More specifically, as shown in FIG. 8, the plunger 685 of the solenoid 680 is being held in the extended position by permanent magnets in the solenoid 680 due to a loss of power thereto. In order to reset the circuit breaker 600 to the closed position, the handle 660 is manually moved to its off or open position, as shown in FIG. 8. This causes the linkage 645 to move to its manually off or tripped position (discussed in more detail above in connection with the circuit breaker 100), thereby causing the contact portion 676 of the lever assembly 675 to pivot further upward and the contacts 605, 615 to pivot even further apart, and causing the magnet 690 to cover/activate the upper of the two Hall effect sensors 691. This movement also pulls the camming member 677 upward such that several things happen.

First, the stationary pin 684 is moved out of the detent 682 in the side 683 of the inner opening 681, and as the camming member 677 moves upward, the pin 684 slides down the side 683 until it reaches the bottom of the generally triangular opening 681. Additionally, the camming member 677 pivots with respect to the contact portion 676 of the lever assembly 675 about the pivot point 678 (i.e., as can be seen in FIG. 8, the upper surface of the camming member 677 to the right of the pivot point 678 is no longer in contact with the underside of the contact portion 676 of the lever assembly 675).

As a result of this upward movement and pivoting of the camming member 677, outer surface of the camming member 677 slides upwardly with respect to the plunger 685 of the solenoid 680, so that the terminal end of the plunger 685 is now disposed in and engaging the lower pocket 679.

Figure 9A:
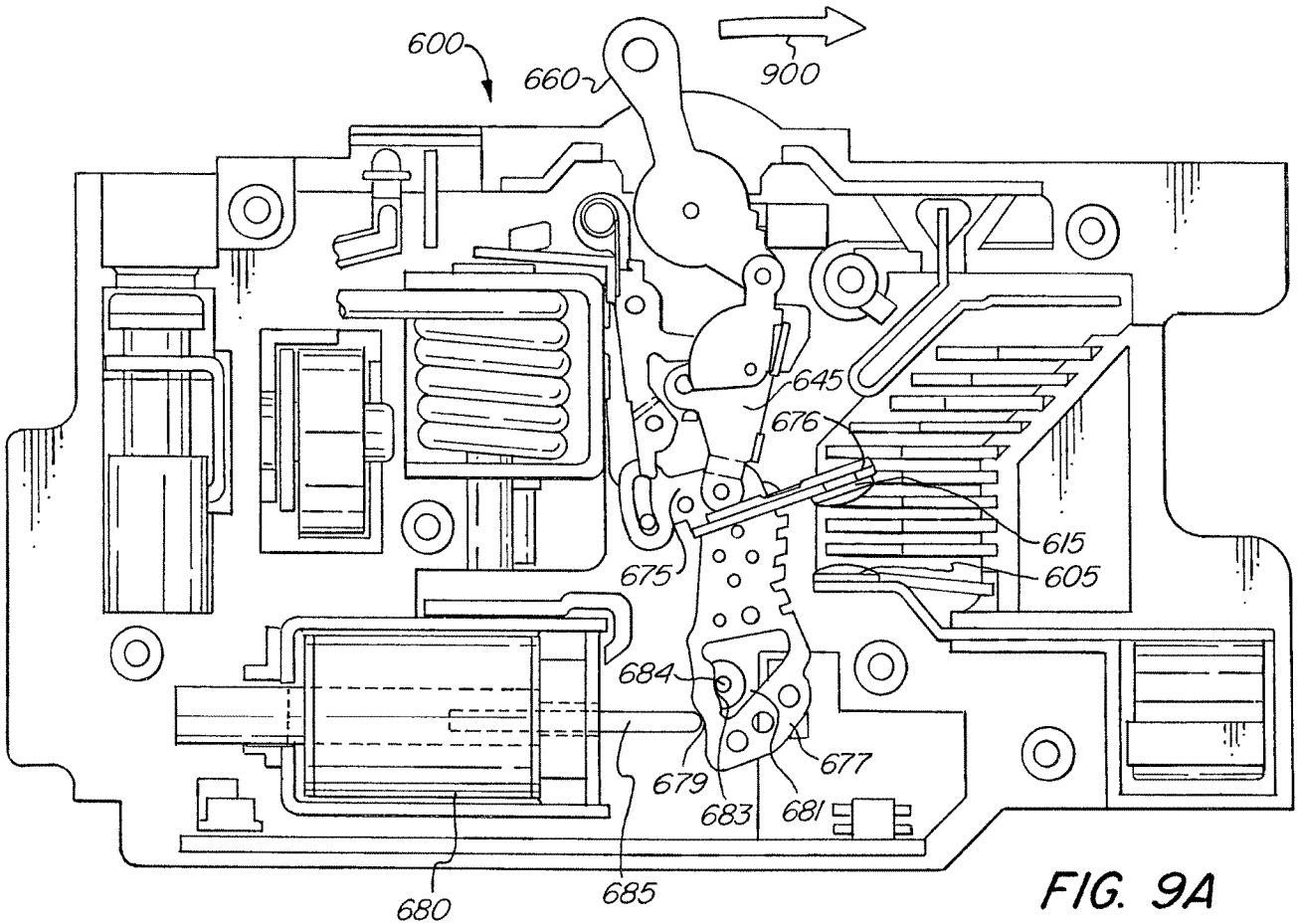
FIGS. 9A and 9B are side views of the second example circuit breaker shown in FIG. 6, showing the plunger of the solenoid being manually reset to the retracted position in the event that DC power to the solenoid has been lost.
Figure 9B:
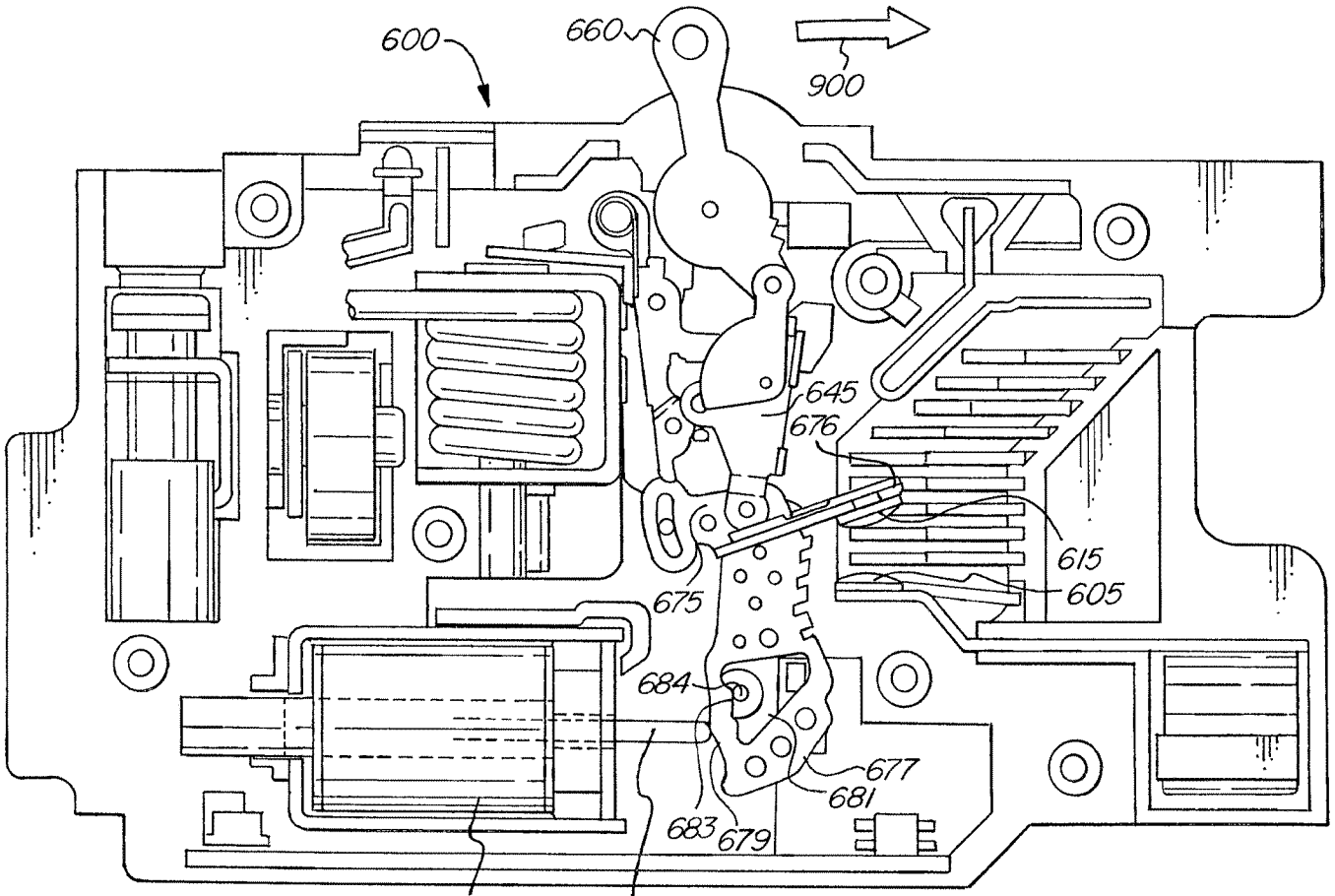

From the position shown in FIG. 8, the handle 660 may now be moved back toward its on/closed position (indicated by arrow 900 in FIGS. 9A and 9B), thereby moving the linkage 645 toward its closed position, and causing the contact portion 676 and the camming member 677 of the lever assembly 675 to pivot through the positions shown in FIGS. 9A and 9B, thereby moving the plunger 685 of the solenoid 680 back out of its extended position despite the force exerted by the permanent magnets of the solenoid, so that the plunger 685 may return to its retracted position and the contact portion 676 of the lever assembly 675 may be biased back to its closed position so that the contacts 605, 615 contact one another and electricity can flow though the circuit breaker 600.

It should be noted that it is not required for movement of the camming member 677 to move the plunger 685 all the way back to its retracted position. Instead, the plunger is 685 is generally held in the extended position by the permanent magnets, but is biased toward its retracted position, such that all that is required is for the camming member 677 to move the plunger 685 far enough (such as to the position shown in FIG. 9B) that the forces of the permanent magnet are weakened and the plunger 685 may be biased back to its retracted position (i.e., returning to the position of components shown in FIG. 6).

This can be accomplished, for example, as follows. As the handle is moved toward its on/closed position, camming member 677 of the lever assembly 675 is moved downward. As this occurs, the stationary pin 684 slides up the side 683 of the inner opening 681, while at the same time, the terminal end of the plunger 685 slides up the outer surface of the camming member 677 and out of the lower pocket 679. Consequently, the horizontal thickness of the portion of the camming member 677 between the stationary pin 684 and the terminal end of the plunger 685 increases (due in part to the raised portion between the pockets 679 of the outer surface of the camming member 677), such that generally opposing outward forces are created on both the stationary pin 684 and the terminal end of the plunger 685.

The stationary pin 684, being stationary, the forces cause the plunger 685 to move to the left, as shown in FIGS. 9A and 9B. Once the plunger 685 has moved far enough, forces biasing the plunger 685 to the left overcome the forces of the permanent magnet holding the plunger 685 to the right, such that the plunger 685 fully retracts.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker comprising:

first and second contacts moveable with respect to each other between a closed state in which electrical current flows through said circuit breaker and an open state in which electrical current is prevented from flowing through said circuit breaker;

a linkage assembly moveable between an engaged position and a disengaged position, wherein when in the disengaged position, said first and second contacts are in the open state;

a remote actuator moveable between an on position and an off position, wherein when said linkage assembly is in the engaged position and when said remote actuator is in the on position, said first and second contacts are in the closed state, and wherein when said linkage assembly is in the engaged position and when said remote actuator is moved to the off position, said first and second contacts are moved with respect to each other to the open state; and a manual reset mechanism that, upon actuation when power has been lost to the remote actuator when the remote actuator is in the off position, physically moves the remote actuator to the on position in the absence of power to the remote actuator, thereby resetting said first and second contacts to the closed state.

2. The circuit breaker of claim 1 wherein said remote actuator comprises a solenoid comprising a plunger and wherein the plunger is moveable between an extended position and a retracted position.

3. The circuit breaker of claim 2 wherein said remote actuator is in the on position when the plunger is in the retracted position and wherein the remote actuator is in the off position when the plunger is in the extended position.

4. The circuit breaker of claim 3 wherein said solenoid comprises at least one permanent magnet biasing the plunger to maintain the extended position when power to the solenoid has been lost.

5. The circuit breaker of claim 4 wherein upon actuation of said manual reset mechanism when power to the solenoid has been lost when the remote actuator is in the off position, the plunger is moved against the bias of the at least one permanent magnet from the extended position to the retracted position.

6. The circuit breaker of claim 1 further comprising a handle manually actuable between an on position and an off position, wherein when the handle is in the on position, the linkage assembly is in the engaged position and wherein when the handle is in the off position the linkage assembly is in the disengaged position.

7. The circuit breaker of claim 6 wherein said manual reset mechanism is actuated, when power has been lost to the remote actuator when the remote actuator is in the off position, by moving the handle from the on position, to the off position and then back to the on position.

8. The circuit breaker of claim 1 further comprising a tripping mechanism that causes the linkage assembly to move from the engaged position to the disengaged position in response to an electrical current passing through the circuit breaker that exceeds a threshold.

9. The circuit breaker of claim 1 wherein one of said first and second contacts is stationary with respect to a housing of the circuit breaker and the other of said first and second contacts is moveable with respect to the housing.

10. The circuit breaker of claim 9 wherein the moveable contact is disposed on a lever assembly that is pivotably mounted with respect to the stationary contact.

11. The circuit breaker of claim 10 wherein the lever assembly is biased toward a position where in the first and second contacts are in the closed state.

12. The circuit breaker of claim 10 wherein the lever assembly comprises a contact portion and a camming member, the moveable contact being carried on the contact portion.

13. The circuit breaker of claim 12 wherein the contact portion and the camming member are connected to one another such that there is limited pivotablity therebetween.

14. The circuit breaker of claim 12 wherein the camming member comprises an outer camming surface facing said remote actuator, said outer camming surface comprising two pockets separated by a protuberance, said pockets adapted to be engaged by a portion of said remote actuator when said remote actuator is in the off position.

15. The circuit breaker of claim 14 wherein the camming member comprises an inner opening with a pin disposed therein, the pin being stationary with respect to a housing of the circuit breaker.

16. The circuit breaker of claim 15 wherein the inner opening is generally triangular in shape with one side thereof being generally parallel to the outer camming surface including the pockets, and with a detent being formed in the side thereof that is generally parallel to the outer camming surface including the pockets, the detent being sided and shaped to engage the pin disposed within the inner opening.

17. The circuit breaker of claim 10 further comprising a sensor assembly for sensing a position of the lever assembly and outputting a position indicative signal.

18. The circuit breaker of claim 17 wherein the sensor assembly comprises a magnet and at least one Hall effect sensor.

19. The circuit breaker of claim 18 wherein the magnet is carried on the lever assembly.

20. The circuit breaker of claim 17 further comprising at least one LED, illumination of which is responsive to the position indicative signal.

21. A circuit breaker comprising:

a housing;

first and second contacts moveable with respect to each other between a closed state in which electrical current flows through said circuit breaker and an open state in which electrical current is prevented from flowing through said circuit breaker, one of said first and second contacts being stationary with respect to the housing and the other of said first and second contacts being moveable with respect to the housing;

a lever assembly pivotably mounted with respect to the housing, the moveable contact being disposed on said lever assembly, the lever assembly being biased toward a position where in the first and second contacts are in the closed state;

a linkage assembly moveable between an engaged position and a disengaged position, wherein when in the disengaged position, said first and second contacts are in the open state;

a handle manually actuable between an on position and an off position, wherein when the handle is in the on position, the linkage assembly is in the engaged position and wherein when the handle is in the off position the linkage assembly is in the disengaged position;

a tripping mechanism that causes the linkage assembly to move from the engaged position to the disengaged position in response to an electrical current passing through the circuit breaker that exceeds a threshold;

a solenoid comprising a plunger moveable between an extended position and a retracted position, wherein when said linkage assembly is in the engaged position and when the plunger of said solenoid is in the retracted position, said first and second contacts are in the closed state, and wherein when said linkage assembly is in the engaged position and when the plunger of said solenoid is moved to the extended position, said first and second contacts are moved with respect to each other to the open state; and a manual reset mechanism that, upon actuation when power has been lost to the solenoid when the plunger is in the extended position, physically moves the plunger of the solenoid to the retracted position in the absence of power to the remote actuator, thereby resetting said first and second contacts to the closed state, wherein said manual reset mechanism is actuated by moving the handle from the on position, to the off position and then back to the on position.

22. The circuit breaker of claim 21 wherein said solenoid comprises at least one permanent magnet biasing the plunger to maintain the extended position when power to the solenoid has been lost.

23. The circuit breaker of claim 22 wherein upon actuation of said manual reset mechanism when power to the solenoid has been lost when the solenoid is in the extended position, the plunger is moved against the bias of the at least one permanent magnet from the extended position to the retracted position.

24. The circuit breaker of claim 21 wherein the lever assembly comprises a contact portion and the camming member, the moveable contact being carried on the contact portion.

25. The circuit breaker of claim 24 wherein the contact portion and the camming member are connected to one another such that there is limited pivotablity therebetween.

26. The circuit breaker of claim 24 wherein the camming member comprises an outer camming surface facing said solenoid, said outer camming surface comprising two pockets separated by a protuberance, said pockets adapted to be engaged by the plunger of said solenoid when the plunger is in the extended position.

27. The circuit breaker of claim 26 wherein the camming member comprises an inner opening with a pin disposed therein, the pin being stationary with respect to the housing.

28. The circuit breaker of claim 27 wherein the inner opening is generally triangular in shape with one side thereof being generally parallel to the outer camming surface including the pockets, and with a detent being formed in the side thereof that is generally parallel to the outer camming surface including the pockets, the detent being sided and shaped to engage the pin disposed within the inner opening.

* * * * *